US005570266A

United States Patent [19]

Testone

[11] Patent Number: 5,570,266

[45] Date of Patent: Oct. 29, 1996

[54] STATIC BAR WITH INDICATOR LIGHT

[75] Inventor: Anthony Q. Testone, Schwenksville, Pa.

[73] Assignee: Electrostatics, Inc., Harleysville, Pa.

[21] Appl. No.: 450,132

[22] Filed: May 25, 1995

[51] Int. Cl.[6] ..... H01T 19/04

[52] U.S. Cl. ..... 361/229; 361/213; 361/230

[58] Field of Search ..... 361/212, 213, 361/225, 229, 230, 231; 340/635, 653, 654, 693; 250/324, 325, 326

[56] References Cited

U.S. PATENT DOCUMENTS

| | | | |
|---|---|---|---|
| 3,654,534 | 4/1972 | Fischer | 361/230 |
| 3,970,932 | 7/1976 | Harvey | 324/133 |
| 4,139,879 | 2/1979 | Laws | 361/230 |
| 4,152,643 | 5/1979 | Schweitzer, Jr. | 340/654 X |
| 4,216,518 | 8/1980 | Simons | 361/230 X |
| 4,271,451 | 6/1981 | Metz | 361/213 |
| 4,271,452 | 6/1981 | Lee | 361/231 |
| 4,814,933 | 3/1989 | Filter et al. | 340/660 X |
| 5,008,594 | 4/1991 | Swanson et al. | 361/231 X |
| 5,065,142 | 11/1991 | Green | 340/660 |

*Primary Examiner*—Fritz M. Fleming
*Attorney, Agent, or Firm*—Nath & Associates; Irvin A. Lavine

[57] ABSTRACT

An air ionizing apparatus, specifically an elongated static bar, is provided with an indicating light capable of being energized by extremely low amperage, such as a neon light. The static bar is connected to a source of alternating current, preferably a flux limiting transformer. Upon shorting out of the ionizing points of the static bar, current flow through the conductor of the static bar is reduced below the minimum operating energy of the neon light, which is then not energized, indicating that the static bar is not functioning.

3 Claims, 2 Drawing Sheets

STATIC BAR WITH INDICATOR LIGHT

BACKGROUND OF THE INVENTION

The present invention relates to static bars, which cause ionization of air to thereby generate ions.

Static bars and other static suppression or eliminating apparatus, also known as air ionizing apparatus, have been widely used. This apparatus provides a relatively high voltage to a sharp point, resulting in the ionization of air adjacent each sharp point in the apparatus. The ionized air is used to eliminate or suppress static electricity on dust, particles, electronic equipment, and sheets of non-conductive material, including paper and plastic, by way of example. Typically, a linearly extending bar is provided, having a plurality of ionizing points in line. Equipment used to provide alternating current to air ionizing apparatus is known as a "power unit," which is a specially constructed current limiting transformer which limits the flux in the secondary windings of the transformer. The "power unit" is usually supplied with alternating electric current from conventional mains which supply current at 120 volts. The secondary windings of the "power unit" operate at 4,000 to 7,000 volts, with very low maximum amperage in the secondary, in the order of five milliamps, due to the flux limiting construction of the "power unit."

Typically, the power unit is provided with an indicator light, which is intended to indicate that the static bar or other ionizing apparatus is "on", that is, that it is being supplied with electric current from a power source through the power unit and that it is functioning to ionize air. Although power units furnished with an indicator light have been widely used for many years, it has been found that the indicator light has given false information: although the indicator light is in the "on" condition, the ionizing apparatus may be essentially non-functioning.

As a consequence, users are misled into believing that the equipment for eliminating static electricity, such as static bars, is ineffective to perform its intended function, which often causes the shut-down of operating apparatus with which the static bars are used to suppress electricity, and causes other related problems.

SUMMARY OF THE INVENTION

An ionizing apparatus, such as a linearly extending static bar with multiple ionizing points has incorporated therewith a neon indicator light. The neon indicator light is capacitively coupled to a conductor forming a part of the ionizing apparatus, and to ground. In a preferred embodiment, the static bar comprises a pair of conductive, facing channels which have a support between them, at one end, which is of insulative material. The conductor which supplies current to the ionizing points passes through the insulating support; the neon indicator light is carried in the support.

An object of the present invention is to provide ion generating apparatus which avoids providing false indication of operativeness of the apparatus.

Yet another object of the present invention is to provide air ionizing apparatus which will produce a valid and reliable signal of the operativeness of the apparatus.

Another object of the present invention is the provision of an air ionizing apparatus in which a low current response indicator light is capacitively coupled to a conductor forming part of the air ionizing apparatus and to which an ionizing point or points is coupled.

Still another object of the present invention is to provide air ionizing apparatus including a power unit, and a low current indicator light for accurately indicating the operative condition of the air ionizing apparatus.

Other objects and many of the attendant advantages of the present invention will be readily understood from the following specification and claims, and by reference to the appended drawings.

DESCRIPTION OF THE PREFERRED EMBODIMENT

Figure 1:
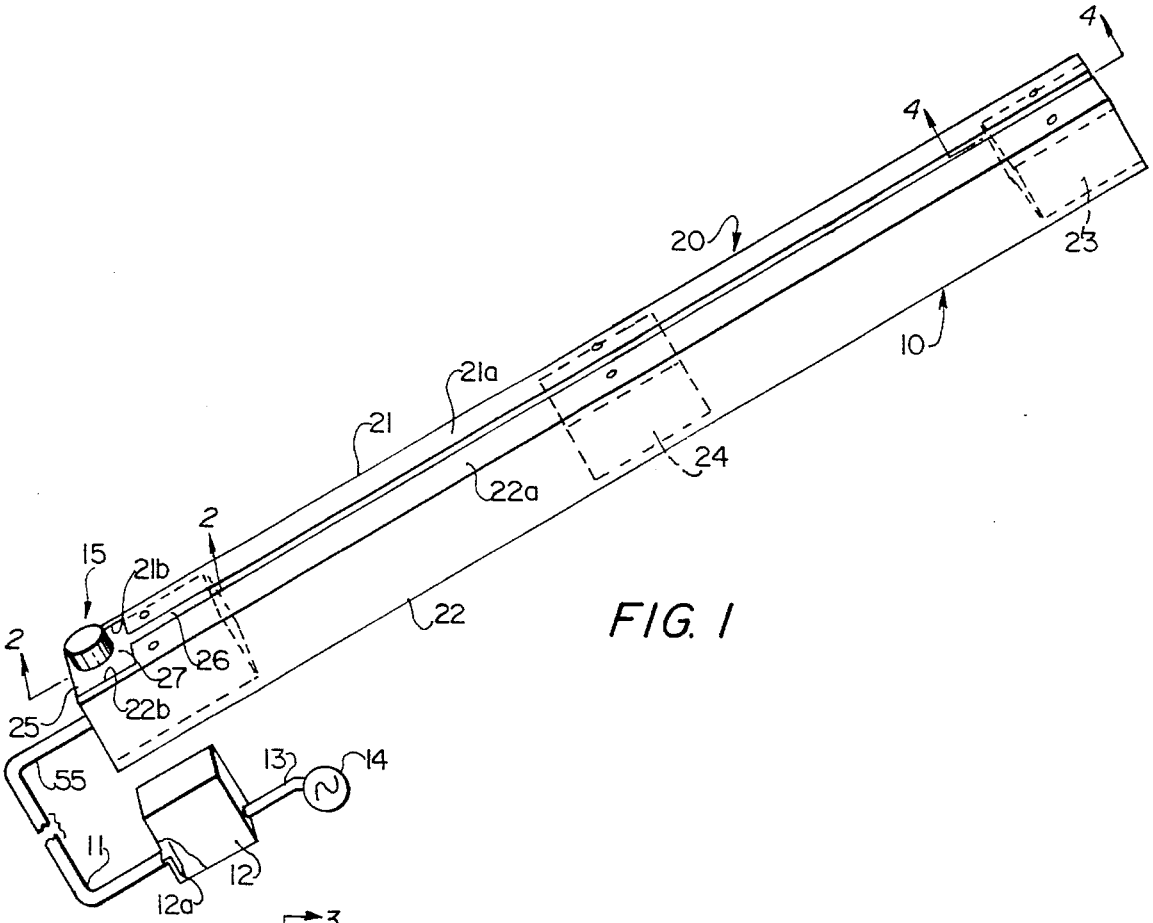
FIG. 1 is a perspective view of a static bar in accordance with the present invention.

Referring now to the drawings, wherein like or corresponding reference numerals are used for like or corresponding parts throughout the several views, there is shown in FIG. 1 an elongated static bar 10 which is supplied with alternating current from a conductor 11 connected to the secondary windings **12*a* of a power unit 12, which is shown partially broken away. Power unit 12, which is a current limiting transformer, is connected by a conductor 13 to a source 14 of alternating current, which is conventionally of 110 volts AC, or may be 220 volts AC. On and forming part of the static bar 10 is an indicator light, generally designated 15**.

The static bar 10 has a housing generally designated 20 which comprises a pair of conductive C-shaped channels 21 and 22. Between the channels 21 and 22 and forming a part of the housing are a distal end support 23, a middle support 24, and a proximal end support 25. The upper flanges **21*a* and 22*a* overlie portions of the proximal end support 25, and are cut out as indicated at 21*b* and 22*b***.

Figure 3:
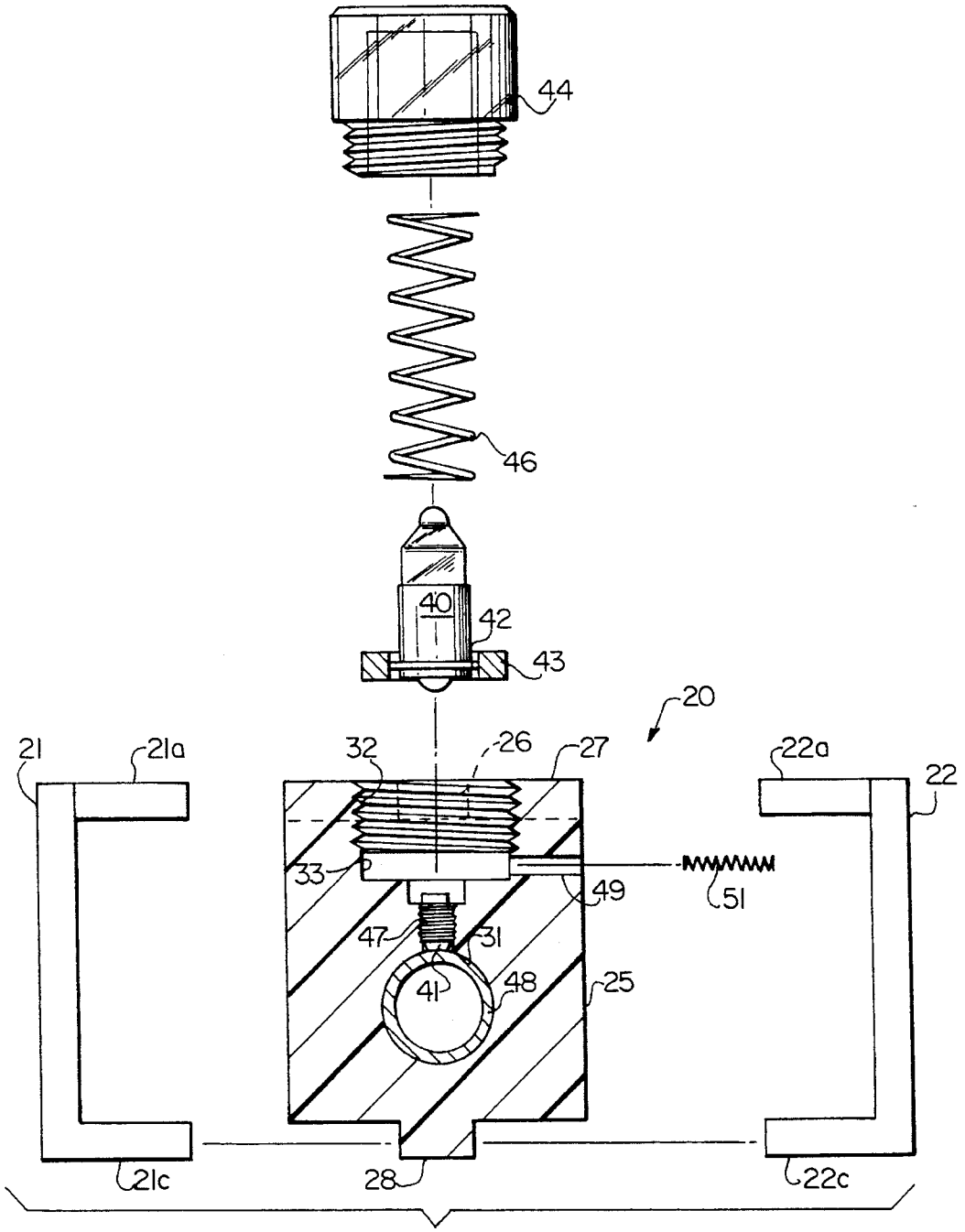
FIG. 3 is an exploded view taken on the line 3—3 of FIG. 2

Proximal end support 25 has on its top an upstanding rib 26 which extends from a platform 27 that projects upwardly from the main portion of support 25. As shown in FIG. 3, support 25 also has a bottom rib 28. In the assembled position, the rib 26 extends upwardly between the upper flanges **21*a* and 22*a* of the channels 21 and 22, and the bottom rib extends downwardly between the lower flanges 21*c* and 22*c*. The cutaway portions 21*b* and 22*b* of the channels 21 and 22 engage the sides of the platform 27 of support 25**.

Figure 2:
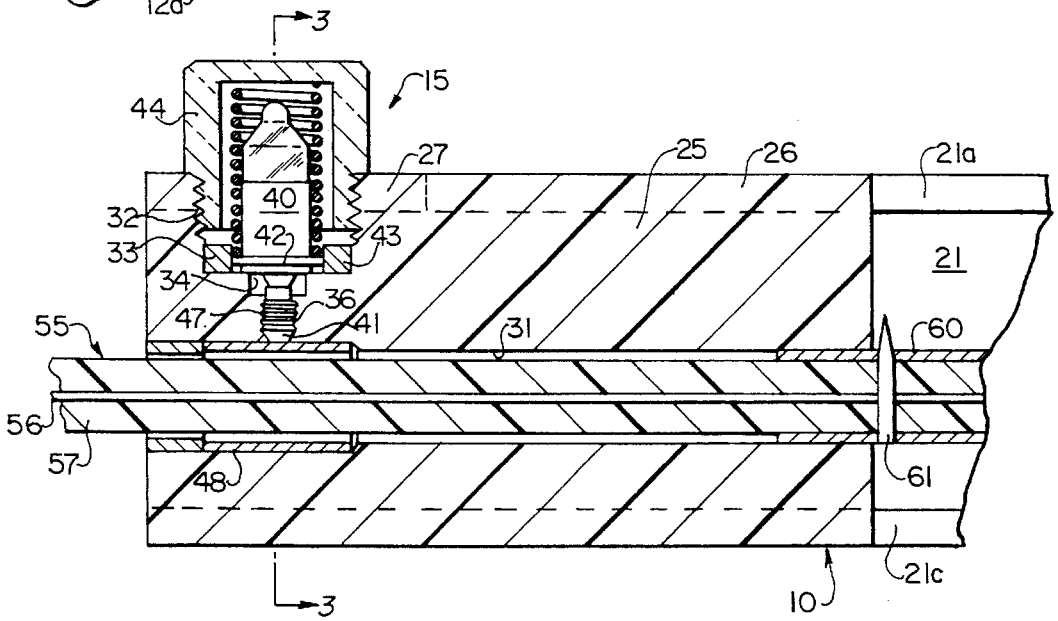
FIG. 2 is a cross-sectional view taken on the line 2—2 of FIG. 1.

As shown in FIG. 2, support 25 has a longitudinally extending passage 31 which is of greater diameter near its proximal end. Transversely of the passage 31 is an upwardly opening threaded bore 32 having a lower portion 33 which is not threaded, a smaller diameter bore 34, and a threaded bore 36. Indicator light 15 comprises a neon light 40 having a first central terminal 41 and an outer terminal 42. Outer terminal 42 is a flange and engages a contact ring 43 in the bore 33. A light transparent housing 44 is threaded into the bore 32, and a spring 46 extends between the underside of the top of the housing 44 and the flange-like outer terminal 42.

Threaded into the bore 36 is a contact 47 which is conductive and which is preferably formed as a set screw with a helical coil. The contact 47 is in engagement with a conductive sleeve 48 which is in the enlarged portion of the passage 31.

Referring to FIG. 3, there is provided a lateral bore 49 which has its inner end adjacent the contact ring 43. A contact spring 51 is in the bore 49 and provides a conductive path from the terminal 42 of neon bulb 40 through contact ring 43 to the channel 22, which is grounded in any known manner.

There is also shown in FIG. 2 a sheathed cable 55 extending through the passage 31, and comprising an inner electrical conductor 56 and an outer insulating cover 57. The sheathed cable 55 passes through the conductive sleeve 48, and into a hollow tube 60. A plurality of ionizing points 61, one of which is shown in FIG. 2, extend diametrically through the tube 60 and the sheathed cable 55 engaging the conductor 56. The proximal end of tube 60 extends into the passage 31 of proximal end support 25.

Figure 4:
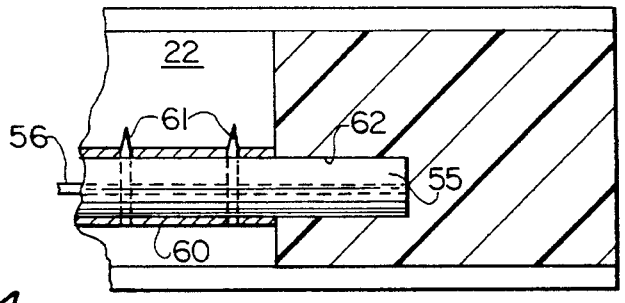
FIG. 4 is a cross-sectional view taken on line 4—4 of FIG. 1.

The tube 60 passes through the middle support 24 and extends to the distal end support 23, as shown in FIG. 4. The support 23 is secured between the channels 21 and 22, and has a bore 62 to receive the end of the sheathed cable 55.

Reference herein to a neon light is intended to include any other indicator which requires only extremely small amperage for operation.

The output of the secondary of the power unit is at approximately five milliamps for effective ionization and is at or below approximately 25 microamps when a short circuit occurs.

In operation, under normal conditions, electric current from the source 14 will be transformed in the power unit 12, and will be conducted through the secondary **12*a* of power unit 12 and conductor 11 to the sheathed cable 55, which may be an extension of conductor 11, or may be connected thereto. Energy from the sheathed cable 55 will be delivered to the neon light 40 and to the ionizing points 61. The neon light 40 will be "on," the capacitor coupling being at 100 pico pico farad capacitance. The amperage in conductor 56 is sufficient to operate the neon light 40, but would be insufficient to operate an incandescent light; the energy from conductor 56 causes ionization of air adjacent points 61**.

Should dirt or other material accumulate in the static bar or other air ionizing apparatus, a short circuit will result, which reduces the current in the conductor 56 in the sheathed cable 55. This reduction results in a loss of power such that there is insufficient power to cause ionization at points 61, and insufficient power to energize the neon light 40, and therefore the neon light of the present apparatus will not be energized. Consequently, the neon light 40 will only be energized when the air ionizing apparatus is functioning to produce ions, and when it is not, the neon light 40 is nor energized. A false signal of operativeness of the ionizing points 61 does not occur in the herein disclosed apparatus.

There has been provided an air ionizing apparatus, specifically a static bar, which will accurately provide an indication of operation of the static bar. Accordingly, there will be avoided with the static bar as herein disclosed, a false signal that the static bar is in operation when in fact ionization is not being effected, and therefore the static bar is not operational.

The claims and specification describe the invention presented, and the terms that are employed in the claims draw their meaning from the use of such terms in the specification. Some terms employed in the prior art may be broader in meaning than specifically employed herein. Whenever there is a question between the broader definition of such term as used in the prior art and the more specific use of the term herein, the more specific meaning is meant.

What is claimed is:

1. An air ionizing apparatus comprising:

a housing comprising an elongated structure and a support of insulating material, said elongated structure comprising a pair of conductive channels capable of connection to ground, said support having a passage therethrough generally parallel to said elongated structure, a conductor in said housing for connection to a source of alternating electric current, said conductor having an insulated sheath thereon, at least one air ionizing point coupled to said conductor for causing ionization of air upon the supplying of alternating electric current to said conductor, a neon indicator light supported by said housing, structure for capacitively coupling said neon indicator light to said conductor comprising a conductive sleeve in said support in surrounding relationship to said insulated conductor, and a conductive contact ring in said support engaging said neon indicator light, and a grounding connector between said conductive contact ring and a said channel, whereby said neon indicator light will be energized only when said apparatus is causing ionization of air by said at least one air ionizing point.

2. The air ionizing apparatus according to claim 1, said grounding connector comprising a spring in a passage in said support.

3. The air ionizing apparatus according to claim 1, and further comprising a power unit for transforming alternating electric current from a source of electric current, said power unit having a secondary, said conductor being connected to the secondary of said power unit.

* * * * *